United States Patent [19]

Kador

[11] 4,334,874

[45] Jun. 15, 1982

[54] LAUNCHING SHEET FOR WINDSURFERS

[76] Inventor: Ulrich Kador, Josef-Fischhaberstr.8e, 8130 Starnberg, Fed. Rep. of Germany

[21] Appl. No.: 121,781

[22] Filed: Feb. 15, 1980

[30] Foreign Application Priority Data

Feb. 19, 1979 [DE] Fed. Rep. of Germany ..... 2906348
May 9, 1979 [DE] Fed. Rep. of Germany ..... 2918698

[51] Int. Cl.[3] ..... A63C 15/05; B63B 15/00

[52] U.S. Cl. .....441/74; 114/90

[58] Field of Search ..... 9/310 E; 114/39, 90, 114/97, 102

[56] References Cited

U.S. PATENT DOCUMENTS 3,455,261 7/1969 Perrin ..... 9/310 E
3,865,061 2/1975 Newman ..... 114/39

FOREIGN PATENT DOCUMENTS 2522115 11/1976 Fed. Rep. of Germany ..... 9/310 E
2712018 9/1978 Fed. Rep. of Germany ..... 114/102
2835827 2/1979 Fed. Rep. of Germany ..... 9/310 E
2365356 5/1978 France ..... 114/39

OTHER PUBLICATIONS

Windsurfer, "Ein Produktohne Tuelkram" 1978

*Primary Examiner*—Ralph J. Hill
*Attorney, Agent, or Firm*—Schwartz, Jeffery, Schwaab, Mack, Blumenthal & Koch

[57] ABSTRACT

A launching sheet or rope for windsurfers is described which facilitates pulling the rig of the windsurfer out of the water. In the case of this launching sheet one of its ends is attached in a conventional manner to the front end of the wishbone-shaped boom, while the other end is attached above the boom to the mast.

13 Claims, 3 Drawing Figures

LAUNCHING SHEET FOR WINDSURFERS

BACKGROUND OF THE INVENTION AND DESCRIPTION OF THE PRIOR ART

This invention concerns a launching sheet or rope for windsurfers.

Conventional windsurfers generally comprise a board and a sailing rig comprising a mast, a boom and a sail. The user stands on the board and controls the sailing rig by gripping the boom which is attached at its front end to the mast and by moving the boom to tilt the mast in the desired direction. Most windsurfers utilize a wishbone-shaped boom, but windsurfers are known which have a beam or holding rope instead of a wishbone-shaped boom. To bring the rig out of the water and into a sailing position, the user pulls on a launching sheet which is attached to the sailing rig.

Launching sheets for windsurfers used heretofore comprise a thick sheet which is attached to the front end of the wishbone-shaped boom and which extends approximately to the mast step.

The sheet hangs down freely or is held taut by means of an elastic sheet, which is knotted or spliced to the sheet in its lower third portion and which is connected to the mast step.

The known launching sheets have the great disadvantage that very great and sometimes even extreme force is necessary in order to pull the rig out of the water and to bring it into the sailing position. This difficulty of erecting the rig is not only a problem for beginners and less trained sportsmen but also for very proficient surfers, especially in the case of strong wind forces.

SUMMARY OF THE INVENTION

The object of the invention is to provide a launching sheet for windsurfers which makes it easier to put the rig in its sailing position, that is to say in a less strenuous manner.

The invention is based on the knowledge that this object can be solved by a sheet, if one of its ends is attached above the wishbone-shaped boom to the mast.

The subject matter of the invention is a launching sheet or rope for windsurfers, in which one of the ends of the sheet is attached to the front end of the wishbone-shaped boom, characterised in that the other end of the sheet is attached above the boom to the mast.

It is advantageous to provide a second sheet which is attached to the first sheet.

The first and/or second sheet preferably consist completely or partially of elastic material.

Very favourable conditions of forces are achieved if one end of the sheet is attached near the mast top.

The length of the sheet should be greater than the distance between its points of attachment.

The inventive sheet permits the rig to be pulled out of the water and brought into its sailing position with a considerably reduced amount of force being applied. This is due, on the one hand, to the fact that if the sheet is attached above the boom to the mast, a longer lever arm is produced which causes a considerable reduction of the required force. On the other hand however, the reduced force required is also based on the anatomy of the human body. When standing upright, a surfer can only pull with comparatively little force. However, if he squats, he will be in the position to pull with much more force. On the other hand, the force required for pulling the rig out of the water is much greater when the point of application of the pulling force is low than when it is high. Due to the saving of force brought about by the prolonged lever arm, the surfer is now in the position to pull in the rig while standing upright, and since less pulling force is required when the application of the pulling force is up higher, the amount of force required for pulling out the rig is further reduced.

It is very important for the aforesaid force reduction in the case of the inventive sheet that one end of the sheet exerts a pull above the boom, the higher the point of origin of the pull, the better. On the other hand, the other end of the sheet must be attached in the region of the boom because it is necessary to ensure that the surfer can change his grip from the sheet to the boom without difficulty when pulling the rig out of the water. The sheet is most preferably embodied in such a way that it can be easily caught hold of when the rig is lying in the water.

BRIEF DESCRIPTION OF THE DRAWINGS

The invention will be described in more detail in the following with reference to the drawing, in which.

DESCRIPTION OF PREFERRED EMBODIMENTS

Figure 1:
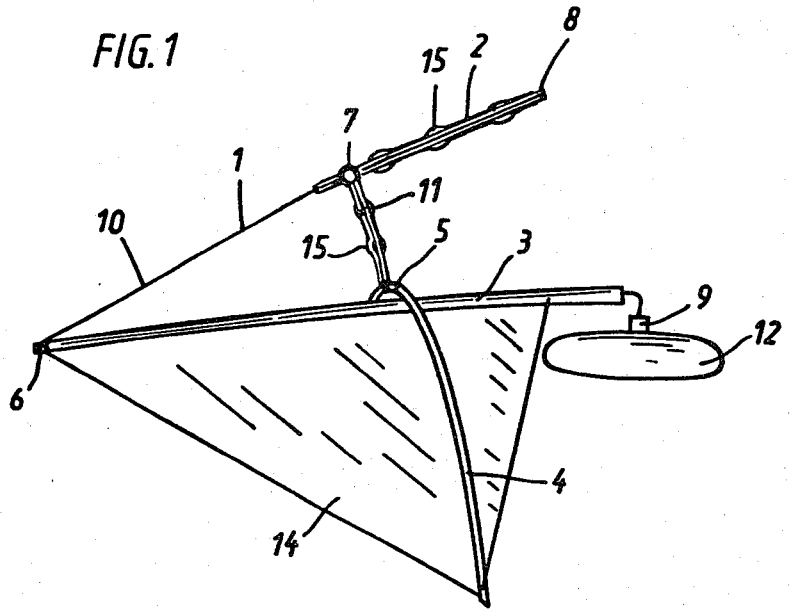
FIG. 1 is a schematic front view of a windsurfer in which the inventive sheet is illustrated as when being pulled and FIG. 2 is a schematic side view of a windsurfer in which the inventive sheet is in its unoperated position.

FIG. 1 shows a windsurfer, which fundamentally consists of a board 12, a mast 3, a wishbone-shaped boom 4 and a sail 14, with its rig, consisting of the mast, the wishbone-shaped boom and the sail, lying in the water.

The inventive sheet 1,2 is illustrated in its initial operated position.

In accordance with this preferred embodiment, the launching sheet or rope comprises a first sheet 1 and a second sheet 2. Alternatively, the second sheet 2 may be omitted, in which case the sheet 1 must be of such a length that it can be easily reached by a surfer standing on the board.

One end of the first sheet 1 is attached above the boom 4 to the mast 3. More particularly, it is attached near to or directly to the mast top 6. The other end of the first sheet is attached to the front end 5 of the boom.

As a general principle, the length of the first sheet 1 is greater than the distance between its points of attachment. This sheet is in particular 5 to 50%, more specifically 10 to 30% and preferably approximately 20% longer than the distance between the points of attachment. It is of particular advantage for the first sheet 1 to exhibit such a length that, roughly speaking, a right angle is produced in the tautened sheet, as shown in the drawing.

The sheet 1 may be attached in a number of ways near the top 6 of the mast. By way of example, the mast top may be provided with suitable means, such as for instance a hole or a ring, to which the sheet is attached. Alternatively, a ring, a loop, a cap or an eye may be provided on the top of the sail, and the sheet may be attached thereto.

A particularly advantageous way of attaching the sheet near the mast top is to attach it by means of an eye 16 in the sail 14 near the top of the mast. The eye may be conventionally provided by means of suitable tools. If no tools for making such an eye are at hand, small, preferably triangular plastic plates, which have holes in their corners, for instance, may be attached by means of screws and nuts to both sides of the sail. The plastic plates are also provided with holes in their mid-portions. The sail is then perforated in such a way that this perforation corresponds to the holes in the plastic plates. The sheet is then attached near the mast top by means of this middle hole, and it can be either directly brought through the hole or a short sheet may be placed through the hole and around the top of the mast and the sheet 1 may be attached to it, if necessary detachably.

The second sheet 2 is attached to the first sheet 1. The second sheet 2 is preferably slidably arranged on the first sheet 1, the second sheet being, for example, attached to a ring which runs on the first sheet. This has the advantage that the first sheet 1 is tautened over the whole of its length when pulling the sail out of the water, with the result that the surfer can change his grip from the sheet 2 to the tautened part 11 of the first sheet.

In the portion 10 between the upper point of attachment and the point of attachment to the second sheet 2, the first sheet may be made of thin material. The portion of the first sheet 11 between the boom and the point of attachment to the second sheet is, however, preferably made of a thick material, in which knots 15 are made in order to facilitate its manipulation. The sheet 2 is also preferably made of a thick material with knots 15.

Figure 2:
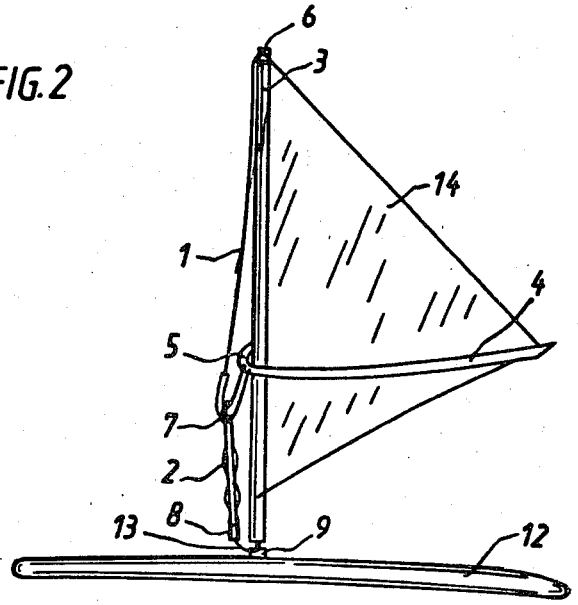
Figure 3:
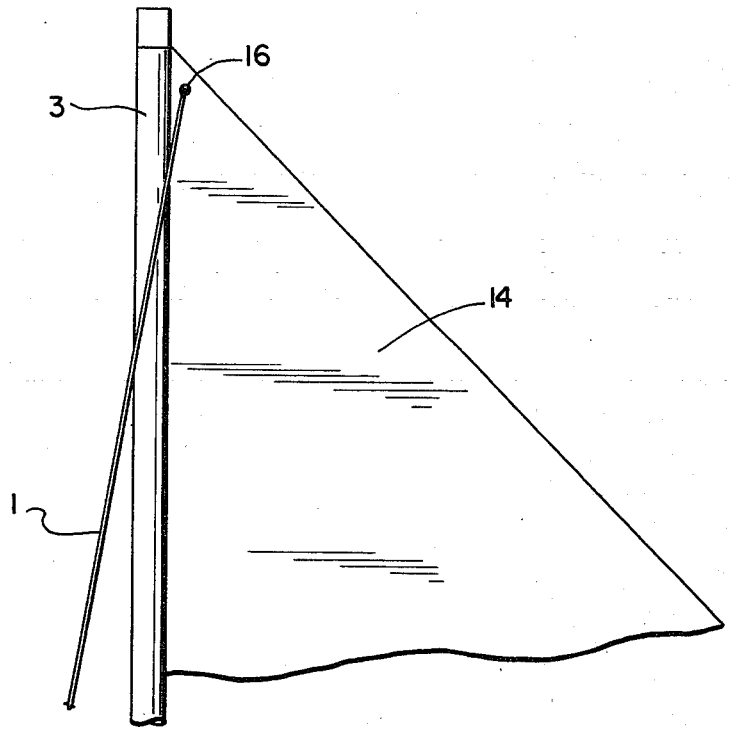
FIG. 3 is an enlargement of the top portion of the sailing rig of a windsurfer showing attachment of the launching sheet through an eyein the sail.

FIG. 2 shows the inventive sheet in its resting position. The first sheet 1 hangs down parallel to the mast 3 due to the weight of the ring 7 and the second sheet 2.

The second sheet 2 is preferably of such a length that its lower end 8 extends to about the mast step 9 when unoperated. The sheet 2 can be conventionally connected to the mast step 9 by means of a rubber sheet or band.

In an alternative embodiment the first sheet 1 is subdivided and comprises a first portion 10, which is connected to the second sheet 2, and a second portion 11, which is slidably attached to the first portion 10 and to the second sheet 2, for instance by means of a ring.

In other embodiments the sheets may completely or partially consist of elastic material. Rubber sheets and rubber-textile sheets, the latter having a defined stretching limit, are particularly suitable as elastic material.

Different pulling conditions can be produced by the use of elastic material for the sheets, and the sheets can also be brought to their rest position parallel to the mast.

By way of example, the portion 10 of sheet 1 and/or the portion 11 of sheet 1 may be made of an elastic material. The portion 11 of the sheet preferably consists of thick elastic material, and the sheet 2 may also consist of such elastic material.

It will be clear that the second portion 11 of sheet 1 can also form an integral single-piece sheet with sheet 2, to which the first portion 10 of sheet 1 is attached at a suitable distance from the end of the boom.

Furthermore, it will be clear that, although the inventive launching sheet is explained here in respect of a conventional windsurfer it is not limited thereto. By way of example, surfers are known which have a beam or holding rope instead of a wishbone-shaped boom. In this case, one end of the inventive sheet is attached to the mast or the beam in their respective connecting areas.

What is claimed is:

1. In a windsurfer having a board, a mast, a wishbone-shaped boom for gripping the windsurfer and a sail, the improvement comprising a launching sheet comprising an elongated member having a first end extending from an attachement point at the front end of said wishbone-shaped boom and a second end extending from an attachment point on said mast above said wishbone-shaped boom.

2. The windsurfer of claim 1 wherein the length of the launching sheet is greater than the direct distance between said attachment points.

3. The windsurfer of claim 1 wherein said second end of the sheet extends from an attachment point near the top of said mast.

4. The windsurfer of claim 3 wherein said attachment point for said second end of the launching sheet to said mast is by means of an eye in said sail.

5. The windsurfer of claim 1 wherein said elongated member comprises at least partially elastic material.

6. The windsurfer of claim 1 further comprising a second elongated member attached to the first elongated member in an area between said first and said second ends.

7. The windsurfer of claim 6 wherein said elongated members comprise at least partially elastic material.

8. The windsurfer of claim 6 wherein said first elongated member comprises a thick material in a portion extending from the end attached to said boom to the area of attachment of said second elongated member with the remainder of said first member comprising a thin material and wherein said second elongated member comprises a thick material.

9. The windsurfer of claim 6 wherein said second elongated member is slidably attached to said first elongated member.

10. The windsurfer of claim 9 wherein said second elongated member is attached to a ring slidably attached to said first elongated member.

11. The windsurfer of claim 6 wherein said first elongated member comprises a first portion to which the second elongated member is attached and a second portion which is slidably attached to said first portion and to said second elongated member.

12. The windsurfer of claim 6 wherein said first elongated member comprises a first portion and a second portion, said second portion and said second elongated member forming a single-piece sheet to which said first portion of said first elongated member is attached.

13. The windsurfer of claim 6 wherein said second elongated member is of sufficient length such that the free end of said second elongated member extends about to the mast step of said windsurfer.

* * * * *